US008092356B2

(12) United States Patent
Seel et al.

(10) Patent No.: US 8,092,356 B2
(45) Date of Patent: Jan. 10, 2012

(54) BIOMECHANICAL EXERCISE DEVICE HAVING A RESILIENT SUPPORT SURFACE

(76) Inventors: David A. Seel, Jasper, MI (US); Jerry E. Seel, Ponte Vedra, FL (US); Gary W. Gray, Adrian, MI (US)

( * ) Notice: Subject to any disclaimer, the term of this patent is extended or adjusted under 35 U.S.C. 154(b) by 0 days.

(21) Appl. No.: 12/621,980

(22) Filed: Nov. 19, 2009

(65) Prior Publication Data

US 2010/0130332 A1 May 27, 2010

Related U.S. Application Data

(60) Provisional application No. 61/116,119, filed on Nov. 19, 2008.

(51) Int. Cl.
*A63B 21/00* (2006.01)

(52) U.S. Cl. ..... 482/146; 482/79

(58) Field of Classification Search ..... 482/146, 482/147, 27, 28, 34, 26, 30
See application file for complete search history.

(56) References Cited

U.S. PATENT DOCUMENTS

| | | | | |
|---|---|---|---|---|
| 3,024,021 | A * | 3/1962 | Coplin et al. | 482/146 |
| 4,653,748 | A * | 3/1987 | Seel et al. | 482/79 |
| 4,830,345 | A * | 5/1989 | Mar | 267/133 |
| 4,986,534 | A | 1/1991 | Meier | |
| 5,509,871 | A | 4/1996 | Giovanni | |
| 6,666,802 | B1 * | 12/2003 | Rasmussen | 482/148 |
| 6,811,523 | B1 | 11/2004 | Timmer | |
| 7,175,577 | B2 * | 2/2007 | Greenspan et al. | 482/146 |
| 7,300,392 | B1 | 11/2007 | Curran | |
| 7,357,767 | B2 | 4/2008 | Tsai | |
| 2004/0018924 | A1 * | 1/2004 | Szydlowski et al. | 482/146 |
| 2008/0214361 | A1 * | 9/2008 | Oster | 482/23 |

* cited by examiner

*Primary Examiner* — Jerome W Donnelly
(74) *Attorney, Agent, or Firm* — MacMillan, Sobanski & Todd, LLC

(57) ABSTRACT

An ankle exercise device increases user comfort and is capable of exercising each ankle without having to switch a fulcrum from one side to the other. The exercise device includes an upper section having a first stiffness characteristic and a lower section that is connected to upper section and has a second stiffness characteristic that is different than the first stiffness characteristic. A fulcrum extends from the lower section and is adapted to support the exercise device for pivoting movement relative to a floor or other support surface.

19 Claims, 4 Drawing Sheets

BIOMECHANICAL EXERCISE DEVICE HAVING A RESILIENT SUPPORT SURFACE

CROSS-REFERENCE TO RELATED APPLICATIONS

This application claims the benefit of U.S. Provisional Application No. 61/116,119, filed Nov. 19, 2008, the disclosure of which is incorporated herein by reference.

BACKGROUND OF THE INVENTION

This invention relates in general to physical therapy exercise and conditioning equipment. In particular, this invention relates to an improved structure for a biomechanical exercise device that increases user comfort and is capable of exercising each ankle quickly and easily.

Various types of physical therapy exercise and conditioning equipment are known in the art. Some devices provide for the specific manipulation of the ankle of the user. One such ankle manipulation device is described and illustrated in U.S. Pat. No. 4,653,748 to Seel et al., which discloses an ankle exercise device that is formed from a flat disc made of a relatively rigid plastic material. The disc includes a first side that is adapted to be engaged by the user to effect movement of a right ankle of the user and a second side that is adapted to be engaged by the user to effect movement of a left ankle. Each side of the Seel et al. disc includes a plurality of indicia (lines) that extend outwardly from a common origin point. The origin point of the indicia are offset relative to the geometric center of the disc, and the shape of the perimeter of the Seel et al. disc is defined by the various indicia emanating from the origin point.

To use the Seel et al. disc, a hemispherical member is initially secured to the side of the ankle exercise device that is opposite of the side that is adapted to be engaged by the user. The hemispherical member is secured to that opposite side at the origin point of the indicia so as to provide a fulcrum point for articulation of the disc. The hemispherical member may further include a cylindrical extension to vary the overall height of the fulcrum. By varying the size of the fulcrum, different angular ranges of motion may be provided for desired ankle exercise routines.

Although the Seel et al. ankle exercise device is effective, it has been found that the rigid flat disc may feel uncomfortable to a user after a period of time. Also, the hemispherical fulcrum of the Seel et al. ankle exercise device must be switched from one side to the other in order to exercise each ankle. Thus, it would be desirable to provide an improved structure for an exercise device that increases user comfort and is capable of exercising each ankle without having to switch the hemispherical fulcrum from one side to the other.

SUMMARY OF THE INVENTION

This invention relates to an improved structure for an exercise device that increases user comfort and is capable of exercising each ankle without having to switch a fulcrum from one side to the other. The exercise device includes an upper section having a first stiffness characteristic and a lower section that is connected to upper section and has a second stiffness characteristic that is different than the first stiffness characteristic. A fulcrum extends from the lower section and is adapted to support the exercise device for pivoting movement relative to a floor or other support surface.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
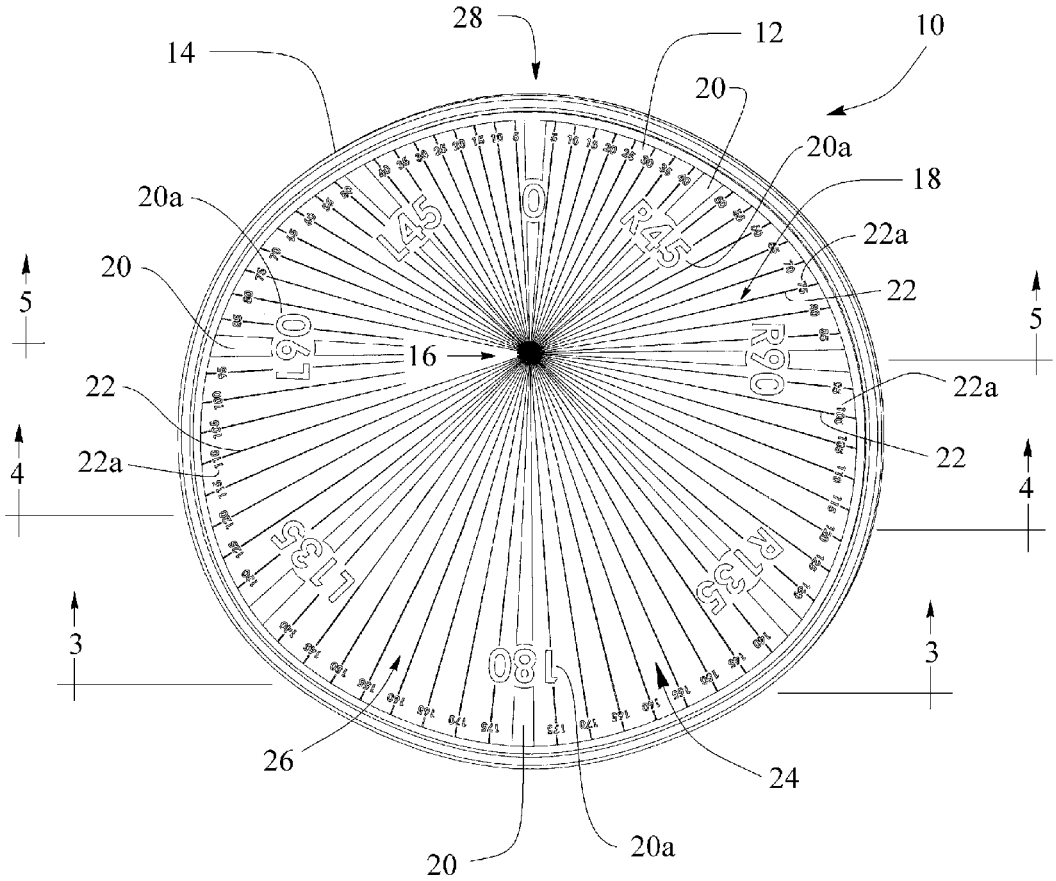
FIG. 1 is a top plan view of a first embodiment of an exercise device in accordance with this invention.

Referring now to the drawings, there is illustrated in FIGS. 1 through 7 a first embodiment of an exercise device, indicated generally at 10, in accordance with this invention. The exercise device 10 will be described and illustrated in the context of a biomechanical ankle exercise device. However, the description and drawings are intended merely to illustrate one environment in which this invention may be used and, therefore, should not be interpreted as limiting the scope of this invention.

The illustrated exercise device is an exercise board 10 and includes a first upper section 12 and a second lower section 14. The first section 12 has an origin point, indicated generally at 16, and a plurality of indicia, indicated generally at 18, that extend outwardly from the origin point 16. In the illustrated embodiment, the origin point 16 is offset relative to a geometric center (not illustrated) of the exercise board 10, although such is not required. In the illustrated embodiment, the indicia 18 are shown as a plurality of radial vectors that extend outwardly from the origin point 16. However, the indicia 18 may have any desired shape or combination of shapes and may extend outwardly from any desired origin point or group of origin points.

In the illustrated embodiment, each of the indicia 18 forms a straight line, wherein each line is oriented at an angle of five degrees relative to an adjacent line. A first group 20 of the indicia 18 are displayed as relatively large lines identified by respective relatively large angular identifiers 20*a*. In the illustrated embodiment, the first group 20 of the indicia 18 are identified by the relatively large angular identifiers "0," "R45," "L45," "R90," "L90," "R135," "L135," and "180." Similarly, a second group 22 of the indicia 18 are displayed as relatively small lines identified by respective relatively small angular identifiers 22*a*. In the illustrated embodiment, the second group 22 of the indicia 18 are identified by the relatively small angular identifiers "5," "10," "15," and so on through "175."

As shown in FIGS. 2 through 7, the first section 12 is an upper section that is supported on the second lower section 14. The illustrated lower section 14 is somewhat larger than the upper section 12, although such is not required. Additionally, the illustrated lower section 14 includes a lip 25 that extends completely about the upper section 12. As a result, the illustrated upper section 12 is received completely within and supported on the lower section 14. In the illustrated embodiment, the lip 25 of the lower section 14 forms a perimeter of the exercise board 10 having a non-circular shape, the purpose of which will be described below. However, the perimeter formed by the lip 25 of the lower section 14 may have any desired shape.

Figure 2:
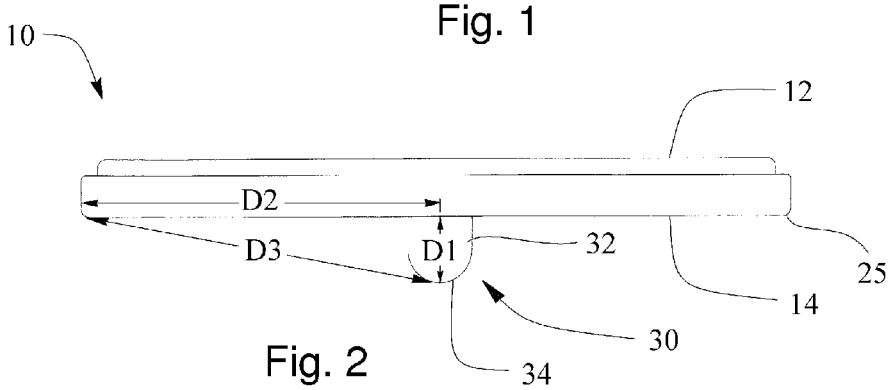
FIG. 2 is a side elevational view of the exercise device illustrated in FIG. 1.
Figure 3:
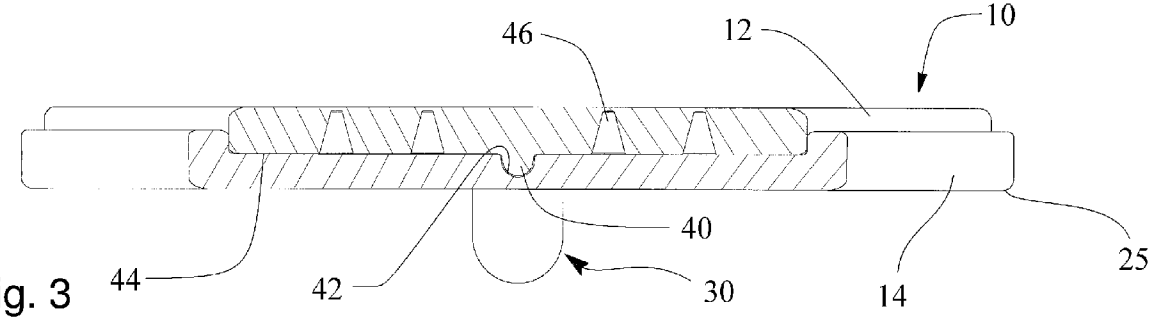
FIG. 3 is a sectional elevational view taken along 3-3 of FIG. 1.
Figure 4:
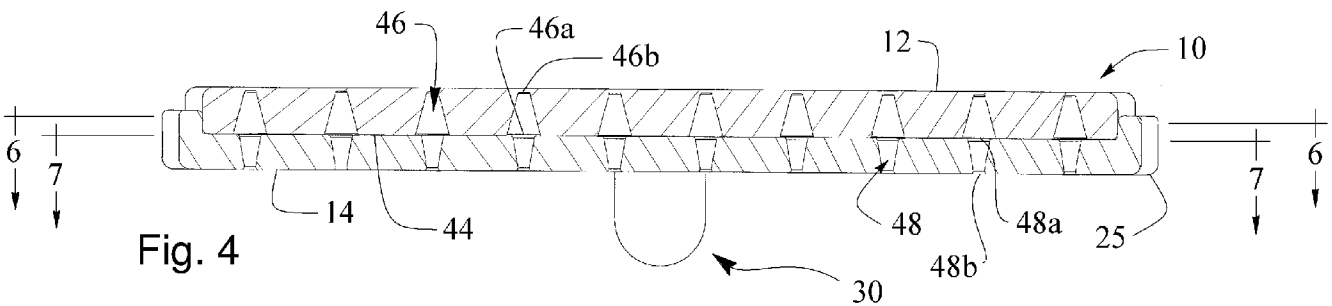
FIG. 4 is a sectional elevational view taken along 4-4 of FIG. 1.
Figure 5:
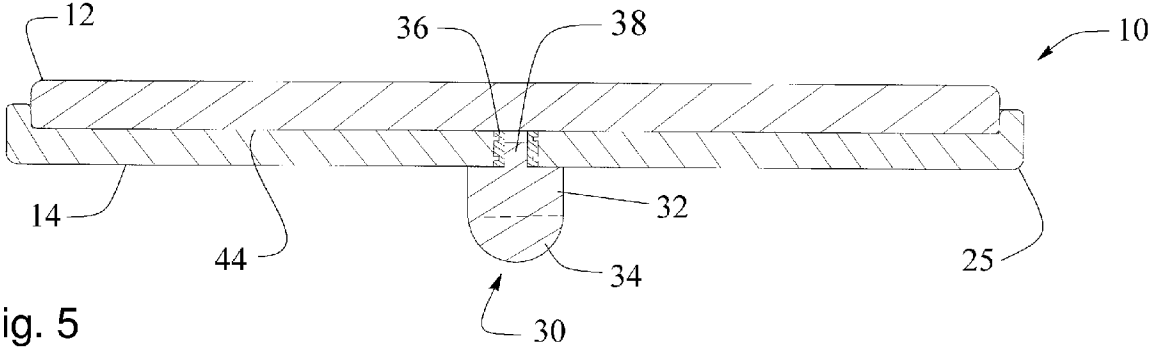
FIG. 5 is a sectional elevational view taken along 5-5 of FIG. 1.
Figures 6, 7:
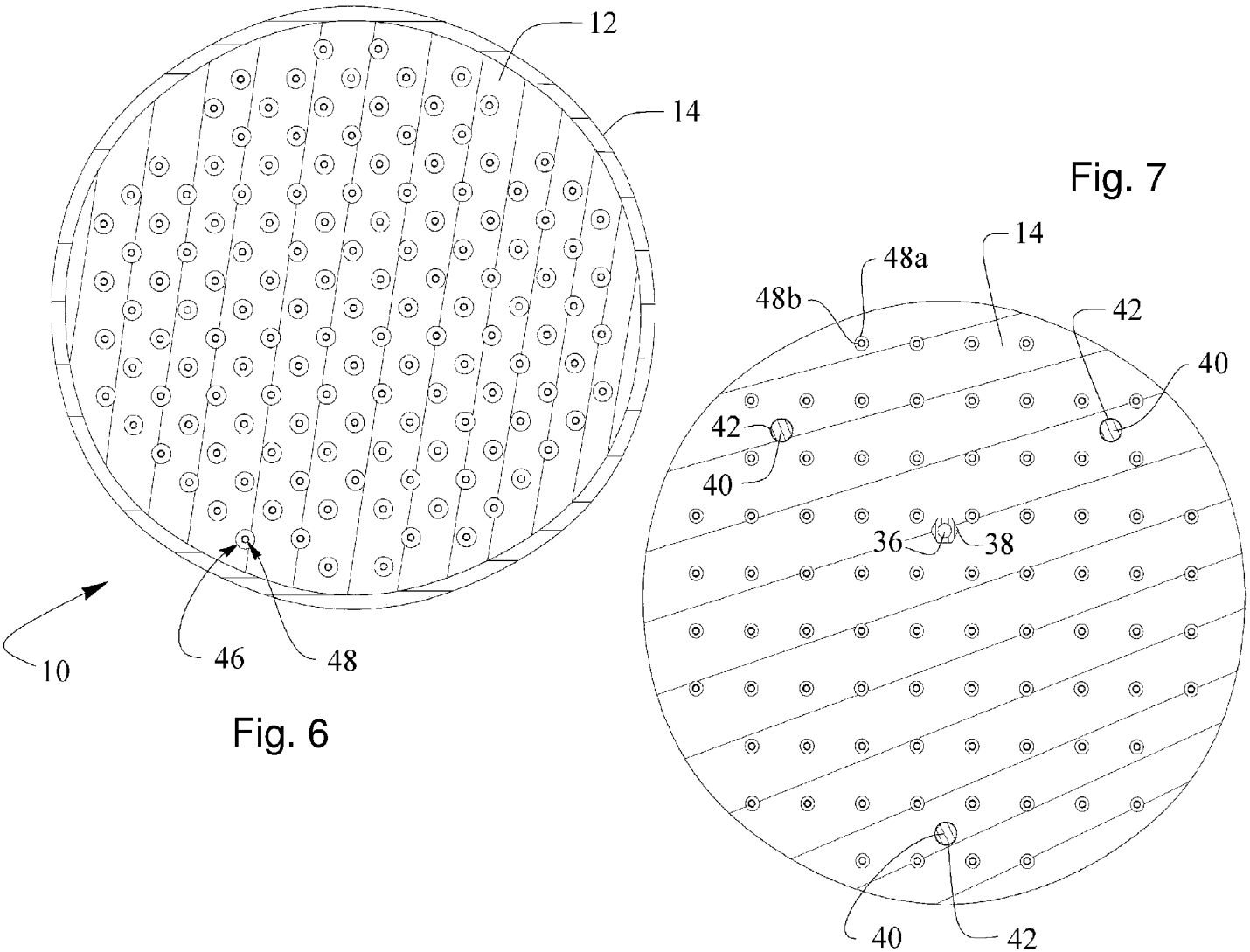
FIG. 6 is a sectional elevational view taken along 6-6 of FIG. 4.
FIG. 7 is a sectional elevational view taken along 7-7 of FIG. 4.

As shown in FIGS. 2 through 5, the exercise board 10 also includes a fulcrum, indicated generally at 30, that extends from the lower section 14. As best shown in FIGS. 2 and 5, the illustrated fulcrum 30 includes a body portion 32 that is secured to the lower section 14 and an end portion 34 that extends from the body portion 32. As shown in FIG. 5, the illustrated body portion 32 of the fulcrum 30 includes a threaded extension 38 that cooperates with a threaded nut 36 embedded within or otherwise secured to the lower section 14. However, the fulcrum 30 may be secured to the lower section 14 in any desired manner or, alternatively, may be formed integrally with the lower section 14.

In the illustrated embodiment, the body portion 32 of the fulcrum 30 is generally cylindrical in shape, having a generally circular cross sectional shape when viewed from above or below, and the end portion 34 of the fulcrum 30 is generally hemispherical in shape. However, the body portion 32 and the end portion 34 of the fulcrum 30 may have any desired cross sectional shapes. For example, the body portion 32 of the fulcrum 30 may have a generally elliptical cross sectional shape when viewed from above or below. If desired, a major axis of this ellipse can be aligned with one or more of the above-described indicia 18 provided on the upper section 12 of the exercise device 10, such as the "0" and "180" indicia, for example.

In the illustrated embodiment, the fulcrum 30 is aligned with the origin point 16, although such is not required. When so aligned, the fulcrum 30 defines a first distance D1 that extends from the surface of the lower section 14 to a tip of the end portion 34. The fulcrum 30 and the lip 25, as illustrated in the embodiment shown in FIG. 2, further define a second distance D2 that extends from the origin point 16 to the edge of the lower section 14. The second distance D2 may vary in length at different points about the circumference of the exercise device 10 depending on the overall shape thereof. A third distance D3 is defined as the distance between the end portion 34 of the fulcrum 30 and the edge of the lower section 14. The resulting triangles, each defined by the distances D1, D2, and D3 around the circumference of the exercise device 10, define the ranges of the various angular deflections that can be achieved during operation of the board.

FIGS. 3 through 7 illustrate various cross sectional views through the exercise board 10. The upper and lower sections 12 and 14 include cooperating pins 40 and sockets 42 that facilitate the alignment and securement of the two sections 12 and 14 together along an interface 44. In the illustrated embodiment, the pins 40 are provided on the upper section 12 and the sockets 42 are provided on the lower section 14, although such is not required. Three pairs of equidistantly spaced pins 40 and sockets 42 are provided in the illustrated embodiment. However, any desired number of pins 40 and sockets 42 may be provided at desired locations. Each of the pins 40 and sockets 42 is illustrated as being generally hemispherical in shape. However, the pins 40 and the sockets 42 may be formed having any desired shapes. The upper section 12 may be secured to the lower section 14 in any desired manner, such as by adhesive, fasteners, or cooperating retainers (not shown) provided on the cooperating pins 40 and sockets 42.

The upper section 12 has a plurality of voids 46 provided therein. In the illustrated embodiment, the upper section voids 46 are arranged in a spaced apart relationship relative to each other. Each of the illustrated upper section voids 46 is shaped as a truncated cone having a relatively large open end 46*a* located adjacent to the interface 44 and a relatively small closed end 46*b* located adjacent to the upper surface of the upper section 12. However, the upper section voids 46 may have any desired shapes. Also, the upper section voids 46 can be provided in any number, size, and geometry to provide a desired stiffness characteristic of the upper section 12.

Similarly, the lower section 14 also has a plurality of voids 48 provided therein. In the illustrated embodiment, the lower section voids 48 are arranged in a spaced apart relationship relative to each other. Each of the illustrated lower section voids 48 is shaped as an inverted truncated cone having relatively large open end 48*a* located adjacent to the interface 44 and a relatively small closed end 48*b* located adjacent to the lower surface of the lower section 14. However, the lower section voids 48 may have any desired shape. Also, the lower section voids 48 can be provided in any number, size, and geometry to provide a desired stiffness characteristic of the lower section 14. In the illustrated embodiment, the lower section voids 48 are generally aligned with the upper section voids 46, although such is not required.

In the first embodiment of the exercise device 10, the upper section 12 is formed from a generally solid material, such as a foam-based material that is either an open cell foam or a closed cell foam. For example, the upper section 12 may be made from a pliable, open cell polyurethane foam that is capable of retaining at least some air or other fluid. Alternatively, the upper section 12 may be formed from of a silicone-based material, a gel, a colloidal solution, or a thixotropic polymer. The type of foam-based material used, along with the size, geometry, and dispersion of the upper section voids 46 if so provided, produces the desired stiffness characteristic of the upper section 12. Alternatively, the upper section 12 may be made from a closed cell foamed material. The closed cell foam material may be used to prevent the upper section 12 from retaining fluid therein. The closed cell foamed material may vary density and durometer, along with the size and dispersion of the plurality of voids 48 if any, to produce the desired stiffness characteristic that is softer than the lower section 14.

Preferably, the upper section 12 of the exercise device 10 has a first stiffness characteristic and the lower section 14 has a second stiffness characteristic that is different from the first stiffness characteristic. In one embodiment, the upper section 12 is softer than the lower section 14. The softer stiffness characteristic of the upper section 12 allows more deflection of the upper section 12 when engaged by a foot or other portion of a user than the harder stiffness characteristic of the lower section 14. The softer stiffness characteristic of the upper section 12 may be achieved, for example, by the selection of the material used to form it, as well as the number, size, and shape of the upper section voids 46. Likewise, the harder stiffness characteristic of the lower section 14 may be achieved, for example, by the selection of the material used to form it, as well as the number, size, and shape of the lower section voids 48.

The lower section 14 may be formed from a material that provides, in part, the stiffness characteristic that is harder than the softer stiffness characteristic of the upper section 12. Such a material may be a hard plastic such as, for example, polyethylene, urethane, polyvinyl chloride, vinyl ester resin, epoxy resin, and the like. Other examples of suitable materials may include wood, reinforced fiberglass and resin, carbon fiber and resin, aluminum, and other metals. The lower section voids 48 may be provided to create the increased stiffness characteristic compared to the upper section 12 through various geometric orientations of the lower section voids 48. The lower section voids 48 may also be provided to reduce the overall weight of the exercise board 10. The lower section voids 48 may be formed completely through the lower section 14 as shown in FIG. 4. Alternatively, the lower section voids 48 may be formed through only a portion of the thickness of the lower section 14, if desired.

The softer stiffness of the upper section 12 provides a resilient user support surface to increase user comfort and provide a measured degree of therapeutic instability to the user. This therapeutic instability permits adjustment of stress levels imparted to the user as target body parts, for example an ankle, are worked or exercised. The upper section voids 46 may also cooperate with the softer material characteristic of the upper section 12 to provide a massage-like sensation to the user's foot. This massage-like sensation may result from the tapered shape of the upper section voids 46 deflecting under the weight of the user. As the tapered upper section voids 46 deflect, the local contact area under the user's foot changes. The changing contact area of the upper section voids 46 may produce a rolling sensation to the underside of the user's foot as the foot deflects into the upper section 12.

The different first and second stiffness characteristics provide an added degree of freedom of movement in the form of an additional deflection of the surface of the upper section 12 when acted upon by the user. While the overall operation of the exercise device 10 is stable, this added degree of freedom produces a localized instability characteristic. The localized instability characteristic works on various body parts to augment the exercise of certain muscle groups over the pivoting deflection of the exercise board 10. In another embodiment, the fulcrum 30 may have a stiffness characteristic that is the same or stiffer than the second stiffness characteristic of the lower section 14. Alternatively, the fulcrum 30 may have a soft or pliable stiffness characteristic that may be similar to the first stiffness characteristic of the upper section.

Referring again to FIG. 1, the indicia 18 may divide the upper section 12 into a plurality of sectors such as, for example, a right side sector 24 and a left side sector 26. However, the indicia may provide for more sectors, no sectors, or different sectors if desired. Other indicia (not shown), along with various foot orientations, will produce deflections about other axes such as, for example, a first and second metatarsal axis, a plantar flexion axis, an axis of inversion and eversion, and a dorsiflexion axis. A first major axis 28 is illustrated as passing through the radial vectors having the "0" and "180" indicia representing the dividing line between the right side sector 24 and the left side sector 26, although such is not required. The various sectors of the upper section 12 may further identify the various foot orientations to provide specific biomechanical articulations of the ankle. The indicia 18 are oriented to indicate where the desired deflections of the exercise device 10 are located relative to plane of a floor or other support surface upon which the exercise device 10 is used.

The deflections result from the articulation of the exercise board 10 about the fulcrum 30 through the angles defined above and shown in FIG. 2. The deflections are controlled, in part, by the non-circular perimeter of the lip 25 that contacts the floor at a localized point on the exercise device 10. The non-circular perimeter 25 may be symmetrical about the first major axis 28, though such is not required. The local contact of the lip 25 to the floor upon which the exercise device 10 is used produces varying deflections of the exercise device 10 relative to the targeted body part that is oriented relative to the indicia 18.

In operation, the user selects the fulcrum 30 having a length for the body portion 32 that provides a desired range of deflections of the exercise device 10. The length of the fulcrum 30 is defined by dimension D1, as shown in FIG. 2. The user places one foot or both feet on the upper section 12. When using one foot, the foot is generally aligned with one of the desired radial vectors 20 in order to define a range of ankle articulations. When oriented, for example, with the user's heel over the origin point 16 and the user's toes pointing toward the "0" indicium 20*a*, the various other radial vectors 20 indicate deflections that articulate the user's ankle through various ranges of biomechanical motion.

For example, in treating an injury such as a lateral, plantar flexion ankle sprain, certain movements are desirable to promote healing and certain movements may exacerbate the trauma. Such desirable movements may be dorsal flexion and eversion of the ankle. Movements causing inversion or plantar flexion of the ankle may delay healing or cause additional trauma and stress to the injured ankle. The indicia 18 of the exercise board 10 permit alignment of the user's foot relative to the various angular deflections of the exercise board 10. For a left ankle lateral sprain, the user may desire to maximize dorsal flexion and eversion movements, while minimizing inversion and plantar flexion movements.

The user orients the left foot on the exercise board 10 with the ankle positioned generally above the origin 16. When the toes of the left foot are pointed toward the indicium marked "L90", the ankle may be flexed with greater degrees of eversion and lesser degrees of inversion. This ability to alter the loading imparted to the ankle is based on the shorter offset distance from the fulcrum 30 to the lip 25, which results in a steeper angular movement of the exercise board 10 toward the "0" indicium. Conversely, the longer distance from the fulcrum 30 to the lip 25 in the direction of the "180" indicium results in a shallower angular movement of the board 10. Thus, the resulting movements of the ankle are tailored to the type of therapeutic movements that are desired. As the foot is moved into alignment with other axes different degrees of ankle articulation and different exercise regiments can be achieved. Other orientations of the foot relative to the indicia 18 produce different exercise regiments. For example, if the left foot is place on the "0-180" axis with the toes pointing toward the "0" indicium, the ankle can be manipulated with generally equal amounts of inversion and eversion. In this orientation, the ankle can also be manipulated with a larger plantar flexion and with lesser amounts of dorsal flexion.

When using both feet, each foot may be oriented on the right and left side sectors 24 and 26, respectively. However, the user's feet may be positioned anywhere on the upper section 12. The smaller vectors 22 and the indicia 22*a* further subdivide the board 10 in order to indicate refined deflection levels associated with the biomechanical articulations of the ankle, for example. The various vectors 20 and the associated indicia 20*a* identify varying amounts of deflection that may be achieved. When using both feet, the user may formulate a sense of balance or proprioception created by the deflections about the fulcrum 30. The deflections of the platform 10 about the fulcrum 30 are further augmented by the differing first and second stiffness characteristics of the exercise board 10.

Figure 8:
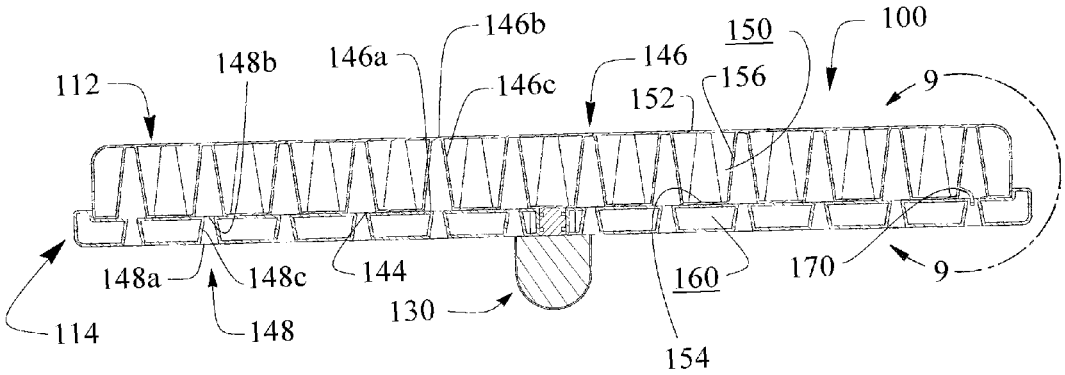
FIG. 8 is a sectional elevational view of a second embodiment of an exercise device in accordance with this invention.
Figure 9:
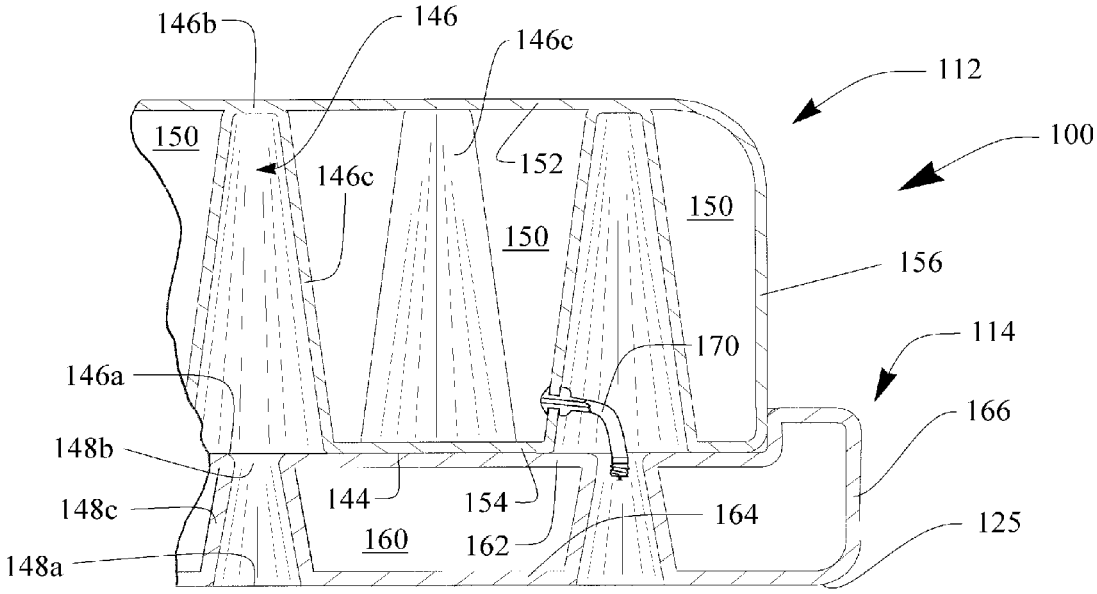
FIG. 9 is an enlarged sectional view taken along 9-9 of FIG. 8.

Referring now to FIGS. 8 and 9, there is illustrated a second embodiment of an exercise board, indicated generally at 100. The second embodiment of the exercise board 100 includes a first upper section, indicated generally at 112, and a second lower section, indicated generally at 114. The upper section 112 may have a relatively soft first stiffness characteristic in the same manner as described above with respect to the upper section 12. The lower section 114 may have a relatively hard second stiffness characteristic in the same manner as described above with respect to the lower section 14. The first and lower sections 112 and 114 engage one another along an interface 144 in a manner similar to the exercise board 10 described above. The embodiment of the exercise board 100 includes a lip 125 and a fulcrum 130 that may be similar in structure and operation to the various embodiments of the fulcrum 30 as described above.

The upper section 112 of the exercise board 100 is a hollow structure having a plurality of upper section voids, indicated generally at 146, provided within a fluid chamber 150. Each of the illustrated upper section voids 146 is shaped as a truncated cone having a relatively large opened end 146*a*, a relatively small closed end 146*b*, and a conically shaped side wall 146*c*. The upper section voids 146 may have any desired shape, size, and relative spacing. The fluid chamber 150 is configured to retain a fluid therein. The fluid chamber 150 is bounded by an upper wall 152, a lower wall 154, and a side wall 156. The fluid contained within the fluid chamber 150 may be any gas, liquid, or thixotropic fluid such as, for example, air, nitrogen, water, gelatinized silicone, and the like. The molded material properties of the upper section 112, along with various characteristics of the fluid such as, for example, pressure, viscosity, temperature, and the like, provide the desired first stiffness characteristic of the exercise board 110. For example, the fluid chamber 150 may be filled with pressurized air and may further be pressurized to 7 or 8 p.s.i. in order to simulate the characteristics of the ground, such as a loosely packed dirt surface.

The lower section 114 of the exercise board 100 is illustrated as a hollow structure having the plurality of lower section voids, indicated generally at 148, provided within a support chamber 160. The support chamber 160 is bounded by an upper wall 162, a lower wall 164, and a side wall 166. Each of the illustrated lower section voids 148 is shaped as a truncated cone having a relatively large opened end 148*a* located adjacent to the lower surface of the lower section 114, a second opened end 148*b* located adjacent to the interface 144, and a conically-shaped side wall 148*c*. However, the voids 148 may have any desired shape, size, and relative spacing.

A valve 170 is in fluid communication with the fluid chamber 150. The valve 170 may be any structure that allows selective filling, pressurization, and removal of fluid to and from to the fluid chamber 150. The valve 170, in the illustrated embodiment, is mounted on one of the side walls 146*c* and extends into one of a plurality of lower section voids 148, although such is not required. The valve 170 may be mounted on any surface and may extend to any suitable location that allows access thereto and fluid communication with the fluid chamber 150.

The various embodiments of the exercise devices 10 and 100 may be manufactured by any process suitable for such structures. In a preferred embodiment, the exercise device 10 may be made from an injection molding process, which is known in the art. The exercise device 100 may be made by rotational molding, which is a process known in the art. Alternatively, any of the various embodiments of the upper sections and the lower sections may be made by any suitable process such as, for example, blow molding, injection molding, spin molding, and slush molding, and the like. The various embodiments of the upper and lower sections may be combined in any desired way to provide a dual stiffness exercise board, if desired.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An exercise device comprising:

an upper section having a first stiffness characteristic, the upper section being hollow and including a plurality of voids;

a lower section connected to the upper section and having a second stiffness characteristic that is different than the first stiffness characteristic, the lower section including a lip that defines a perimeter; and a fulcrum extending from the lower section, the fulcrum and the lip being configured to define a varying maximum angular deflection of the upper section relative to a support surface.

2. The exercise device of claim 1 wherein the first stiffness characteristic of the upper section is softer than the second stiffness characteristic of the lower section.

3. The exercise device of claim 1 wherein the upper section includes a void.

4. The exercise device of claim 1 wherein the lower section includes a void.

5. The exercise device of claim 1 wherein the upper section is made from a generally solid material and includes a plurality of voids.

6. The exercise device of claim 5 wherein the generally solid material is a foam-based material.

7. The exercise device of claim 1 wherein the lower section is hollow and includes a plurality of voids.

8. The exercise device of claim 1 wherein the hollow upper section defines a fluid chamber that contains a fluid.

9. The exercise device of claim 8 wherein the fluid is air.

10. The exercise device of claim 1 wherein the upper section includes a foam material.

11. The exercise device of claim 1 wherein the fulcrum has a stiffness characteristic that is the same as the stiffness characteristic of the lower section.

12. The exercise device of claim 11 wherein the fulcrum has a pivot portion that is hemispherical.

13. An exercise device comprising:

an upper section having a first stiffness characteristic;

a lower section connected to the upper section and having a second stiffness characteristic that is different than the first stiffness characteristic, the lower section including a lip that defines a perimeter; and a fulcrum extending from the lower section, the fulcrum and the lip being configured to define a varying maximum angular deflection of the upper section relative to a support surface wherein the fulcrum has a stiffness characteristic that is the same as the stiffness characteristic of the upper section.

14. The exercise device of claim 1 wherein a limit of the angular deflection of the upper and lower support surfaces is defined by contact of the lip and the fulcrum with the support surface.

15. The exercise device of claim 1 wherein the lip perimeter is non-circular.

16. The exercise device of claim 14 wherein the upper support surface includes a plurality of indicia that define a plurality of sectors configured to identify foot orientations to provide specific biomechanical articulations of the ankle.

17. The exercise platform of claim 15 wherein the upper surface includes an origin point and the indicia are radial lines between the origin point and the upper surface perimeter, the radial lines configured to identify at least one of a first and second metatarsal axis, a plantar flexion axis, an axis of inversion and eversion, and a dorsiflexion axis.

18. An exercise device comprising:

an upper section having a fluid chamber that defines a first stiffness characteristic, the upper section including an origin point and a plurality of radial indicia extending from the origin point to a perimeter of the upper section;

a lower section connected to the upper section and having a second stiffness characteristic that is stiffer than the first stiffness characteristic, the lower section including a lip that defines a non-circular perimeter; and a fulcrum extending from the lower section, the fulcrum and the lip being configured to define an angular deflection of the upper section relative to a support surface along one of the plurality of indicia.

19. The exercise device of claim 1 wherein the upper section includes a layer comprising one of a silicone-based material, a gel, a colloidal solution, and a thixotropic polymer.

* * * * *